United States Patent [19]

Longenderfer et al.

[11] Patent Number: 4,558,262

[45] Date of Patent: Dec. 10, 1985

[54] LOAD SWITCHING ARRANGEMENT FOR GAS DISCHARGE LAMP CIRCUIT

[75] Inventors: John E. Longenderfer, Orefield; David G. Luchaco, Macungie; Dennis Capewell, Easton, all of Pa.

[73] Assignee: Lutron Electronics Co., Inc., Coopersburg, Pa.

[21] Appl. No.: 473,800

[22] Filed: Mar. 9, 1983

[51] Int. Cl.[4] ..... H05B 41/38

[52] U.S. Cl. ..... 315/307; 315/297; 315/130; 315/360

[58] Field of Search ..... 315/307, 297, 360, 362, 315/130, DIG. 5

[56] References Cited

U.S. PATENT DOCUMENTS

| | | | |
|---|---|---|---|
| 3,875,460 | 4/1975 | Kappenhagen | 315/307 X |
| 4,189,664 | 2/1980 | Hirschfeld | 315/307 X |
| 4,350,935 | 9/1982 | Spira et al. | 315/291 |
| 4,434,388 | 2/1984 | Carver et al. | 315/297 X |

FOREIGN PATENT DOCUMENTS

| | | | |
|---|---|---|---|
| 52-14081 | 2/1977 | Japan | 315/307 |

*Primary Examiner*—Palmer C. DeMeo
*Assistant Examiner*—Vincent DeLuca
*Attorney, Agent, or Firm*—Ostrolenk, Faber, Gerb & Soffen

[57] ABSTRACT

Individual banks of gas discharge lamps are provided with a common dimming control system. If a bank of lights is turned on while others are on and in a dimmed condition, the voltage applied to all lamps is increased over a relatively short period of time to full voltage to ensure the proper striking of the new bank of lamps but over a sufficiently long time period that users of the dimmed banks of lamps will not be noticeably affected by the change in lamp output. Full power is then maintained for a sufficiently long time to ensure proper lamp striking and stabilization and all banks are then very gradually returned to the original dimmed illumination condition which was set before the new lamp bank was energized. A long time delay and a short time delay are applied to respective inputs of a comparator to enable the initiation of the lamp striking sequence for the new lamp bank and prevents the initiation of the lamp striking sequence due to short time disturbances on the line.

14 Claims, 4 Drawing Figures

LOAD SWITCHING ARRANGEMENT FOR GAS DISCHARGE LAMP CIRCUIT

RELATED APPLICATIONS

This application is related to copending application Ser. No. 473,799, filed Mar. 9, 1983, now U.S. Pat. No. 4,527,099 entitled "Control Circuit for Gas Discharge Lamps", in the names of Capewell, Luchaco and Spira and is assigned to the assignee of the present invention.

BACKGROUND OF THE INVENTION

This invention relates to a novel load switching control circuit for controlling the switching of new lamp banks of illumination control systems employing dimming control, and more specifically relates to a novel control system which ensures successful switching of new lamp banks into the system without producing annoying effects on those working in areas which are illuminated by dimmed lamps which are energized from the same control system.

It is well known that a large number of banks of gas discharge lamps, such as fluorescent lamps, can be energized from a common power source and controlled in illumination output by a common dimmer control circuit. In such systems, however, if a new lamp bank is to be added to the existing energized banks, some means must be provided to apply a sufficiently high voltage to the new bank to ensure its adequate striking.

U.S. Pat. No. 4,350,935, issued Sept. 21, 1982, entitled Gas Discharge Lamp Control, in the name of Joel S. Spira et al, and assigned to the assignee of the present invention describes circuits for applying additional energy to new banks of lamps which are to be connected in parallel with other banks of lamps which are already excited but are driven at a relatively lower voltage in order to dim their illumination output. The additional energy was taken from various energy storage means and required fairly complicated additional circuitry for its implementation.

Other systems are known in which, when additional banks are to be added to previously dimmed banks of lamps, the entire circuit is switched to full output voltage, thus causing the dimmed lamps to immediately increase from their dimmed illumination level to their full level but assuring adequate striking of the new lamps. However, the flicker which is caused by immediately changing light intensity from the dimmed value to the full value will be annoying to occupants of the area in which the illumination had been dimmed. After a short time, for example, 90 seconds, the lamps are returned to the dimmed setting.

BRIEF DESCRIPTION OF THE INVENTION

In accordance with the present invention, a novel sequence is provided for energizing a new bank of lamps in parallel with an existing bank of lamps which are operated at any dimmed level, where the sequence is relatively unnoticeable to occupants of spaces containing the energized lamps while striking of the new lamps is ensured.

The system of the invention is applicable to any desired type of gas discharge lamp including, but not limited to, all types of fluorescent lamps and high intensity discharge lamps.

It has been found that when lamps are ramped up from a dimmed condition to a sufficiently high output, for example, 100% illumination output over a period of approximately 1–3 seconds, and then held at 100% for more than about 30 seconds, and then slowly dimmed back to the original dim setting in approximately 30 seconds, the entire switching operation will be practically unnoticeable to those working in the controlled area and striking of the new lamps or the new bank of lamps is assured. Note that where we refer hereinafter to 100% illumination output or full illumination output, we intend to include any illumination output level sufficient for reliable lamp striking.

Although ramping to 100% illumination over an approximate 3 second interval takes somewhat longer to strike the lamps which are switched on than if there was an immediate jump to 100%, tests have indicated that no significant reduction of lamp life is caused by the longer strike time.

The invention provides substantial economic advantages. Thus, it avoids the need for separate switching and additional energy supply means for each individually controlled groups of lamps and is user-acceptable. Moreover, with the present invention, the control arrangement can be added directly to the lamp energy control circuits without additional installation effort or specification considerations on the part of the customer.

The novel system of the invention requires means to determine when additional lamps have been switched on regardless of the dimmed setting of the lamp. This can be done through the use of wiring from each lamp bank switch back to the control unit. However, the necessary wiring for this arrangement can be eliminated by providing current transformer sensing of the total load current of the control circuit. Thus, switching will occur in the novel load switch sequence whenever a current increase is measured greater than some preset amount, which would be caused by switching on of additional load banks. Such current detection can take place entirely within the confines of the control unit, thereby avoiding additional wiring.

A novel circuit is provided which is responsive to RMS load current and which employs two time delays; a long time delay and a short time delay, which are connected to the positive and negative terminals of a comparator. If the RMS load current changes by a predetermined amount and if the change remains for greater than a line transient-related time which should not initiate a new lamp striking sequence, the comparator will fire to initiate the lamp striking sequence.

The novel load switching circuit can be used for the control of any load switching sequence for any illumination control system but is particularly applicable to the circuitry shown in copending application Ser. No. 473,799, referred to above.

DETAILED DESCRIPTION OF THE DRAWINGS

Figure 1:
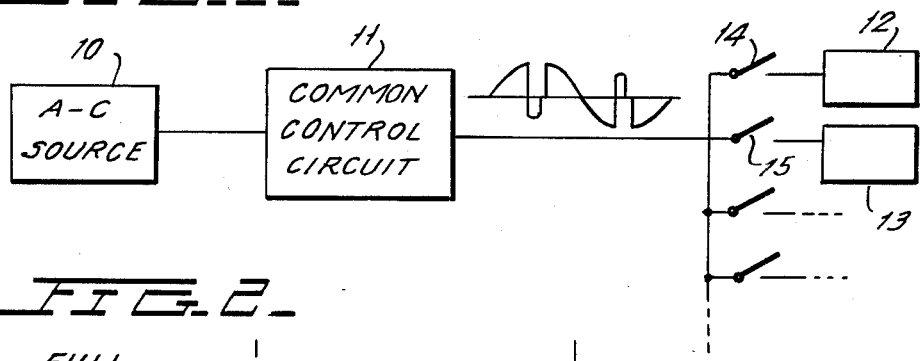
FIG. 1 is a schematic block diagram of the novel control system of the present invention.

Referring first to FIG. 1, there is shown a block diagram of a system in which an a.c. source 10 applies power through a common control circuit 11 which may be of the type described in aforementioned copending application Ser. No. 473,799, and produces an output voltage having the notched configuration shown to the right of circuit 11. Note, however, that the output voltage characteristic of other circuits, such as that of U.S. Pat. No. 4,350,935 could also be used. Note also that a.c. source 10 could be a d.c. source or any other type source desired.

The common control circuit output voltage is applied to a plurality of lamp and ballast combinations 12, 13 and others which are respectively connected to the control circuit 11 output as by appropriate wall switches 14 and 15 or the like. A large plurality of lamps and ballast combinations with respective wall switches can be provided.

If switch 14 is closed and lamp and ballast combination 12 are being energized, it is likely that the lamp illumination level will be reduced by a notch of given width in the input voltage to the lamp and ballast combination 12. If now it is desired to also energize lamps 13 by closing switch 15, the output voltage available from the common control circuit 11 may be too low to cause striking of the gas discharge lamps in the combination 13.

Accordingly, and in accordance with the invention, the common control circuit 11 will relatively gradually increase the voltage to the lamps and ballasts until full voltage is applied to the lamp and ballast 13 to ensure adequate striking. At the same time, the illumination output of the lamps in the combination 12 will be increased relatively gradually so as to not disturb the occupants of the area illuminated by those lamps.

Figure 2:
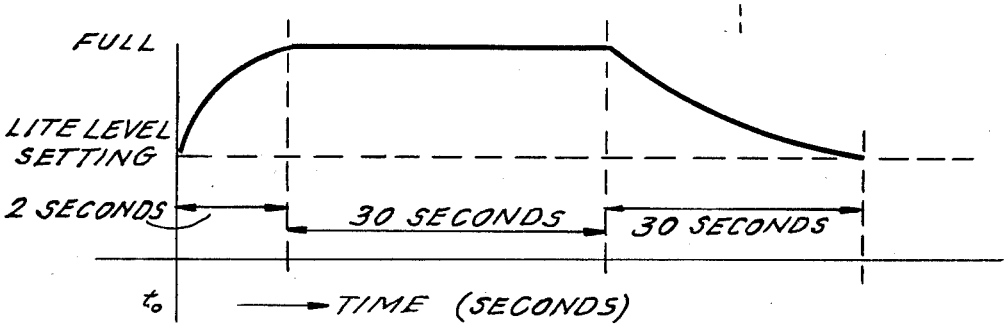
FIG. 2 schematically illustrates, as a function of time, the novel control sequence of the present invention.

FIG. 2 shows a light level control sequence which has been found to provide user comfort and ensure striking of new lamps 13 which are to be connected in place. In FIG. 2, time $t_0$ is the time of connection of a new bank. At time $t_0$, the light level setting of lamps 12 is indicated by dotted lines, which might be 50% of the full available light level setting indicated by dotted lines which might be 50% of the full available light output.

In accordance with the invention and as will be later described, upon the sensing of the closure of switch 14 or of the switch of any other bank of lights, the common control circuit 11 is automatically operated to increase the illumination output to full intensity in approximately 1–3 seconds, and preferably about 2 seconds. This increase can follow any desired increase characteristic with time and may be exponential. It has been found that occupants of the area which is illuminated by lamp 12 at a dim setting of, for example 50%, will not be consciously aware of this change of lamp intensity over the 2 second interval. The interval can be shortened to 1 second, but the change is then more noticeable. A shorter interval is desirable since a shorter time produces more reliable striking. It has been found that the interval can be extended up to 3 seconds without causing permanent damage to the lamps due to slower striking of the new lamps. It has been found that 2 seconds is a good compromise between user comfort and reliable striking.

Once the full voltage output is reached in FIG. 2, the output remains at full for approximately 30 seconds or more in order to ensure proper lamp striking and stabilization. A longer time may be required for high intensity discharge lamps.

Thereafter, the lamp output intensity of all banks of lights which are connected to the common control circuit 11 are dimmed back to the original light level setting shown in dotted lines in FIG. 2 in about 30 seconds or more. Any desired decreasing characteristic with time can be used and could also be exponential. This change will not be noticeable to occupants of areas containing the lights. This 30 second dimming time will also assist in allowing the lights to stabilize without dropping out.

It is desirable to ensure that the lamp striking sequence of FIG. 2 is not initiated due to a momentary pulse on the line which might be mistaken for an increase in lamp current due to the connection of a new lamp bank.

Figure 3:
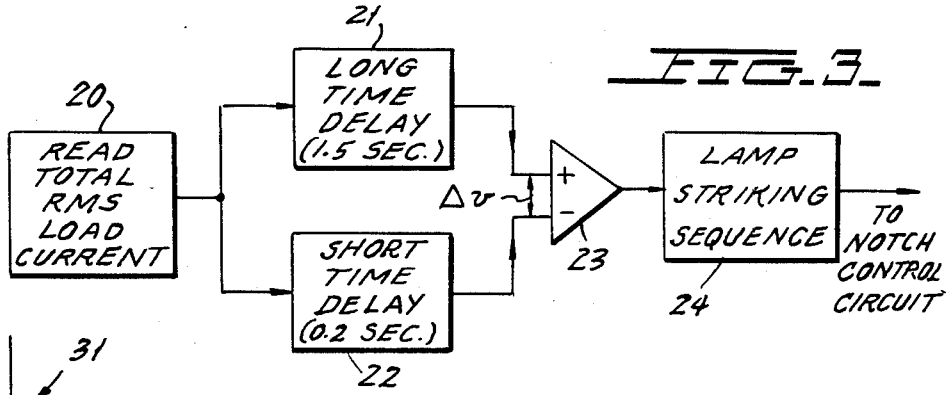
FIG. 3 is a block diagram of the circuit of the present invention which permits the initiation of the new lamp striking sequence.

FIG. 3 shows a novel circuit in block diagram form for preventing the inadvertent initiation of the lamp striking sequence. Referring to FIG. 3, a suitable circuit 20 is provided to measure the total RMS load current flowing from the a.c. source in FIG. 1. Note that the circuit is contained to the left of switches 14 and 15 et seq., and is contained within the main power module or control circuit 11. Thus, external wiring or devices for detection of load switching are not needed.

The signal representative of total RMS load current is then applied to a circuit including a long time delay circuit 21 and a short time delay circuit 22. The long time delay circuit may have a delay of 1.5 seconds and the short time delay circuit may have a delay of about 0.2 second. The long time delay circuit 21 is a sample and hold circuit which will adjust to new load levels as these levels change as measured by the reading circuit 20.

The time delay circuit outputs are then connected to the positive and negative terminals, respectively, of comparator 23, which may be a type LM399 comparator. The output of the comparator 23 is then connected to an appropriate lamp striking sequence initiating circuit 24 which produces an output suitable for performing the dimming pattern shown in FIG. 2 by appropriately controlling the notch width of the common control circuit 11 in FIG. 1.

The short time delay circuit will monitor changes in the total RMS load current and produce an output $\Delta v$ across the inputs of comparator 23. When the negative terminal is sufficiently higher than that of the positive input, the comparator will fire to activate the lamp striking sequence shown in FIG. 2.

The specific values of the time delays for circuits 21 and 22 must be carefully chosen. The time delay of the short time delay circuit 22 cannot be so fast that it would cause false tripping due to normally occurring line disturbances. However, if it is too slow, the output $\Delta v$ will not become great enough to activate the lamp striking sequence circuit 24. The long time delay 21 cannot be too slow since the circuit reset time would then be too long. Thus, if another load switch occurs during the reset time, the lamp striking sequence 24 may not respond and the new lamps may not strike. Thus, the selection of the time delays are crucial to proper operation of the ramp striking sequence function.

Figure 4:
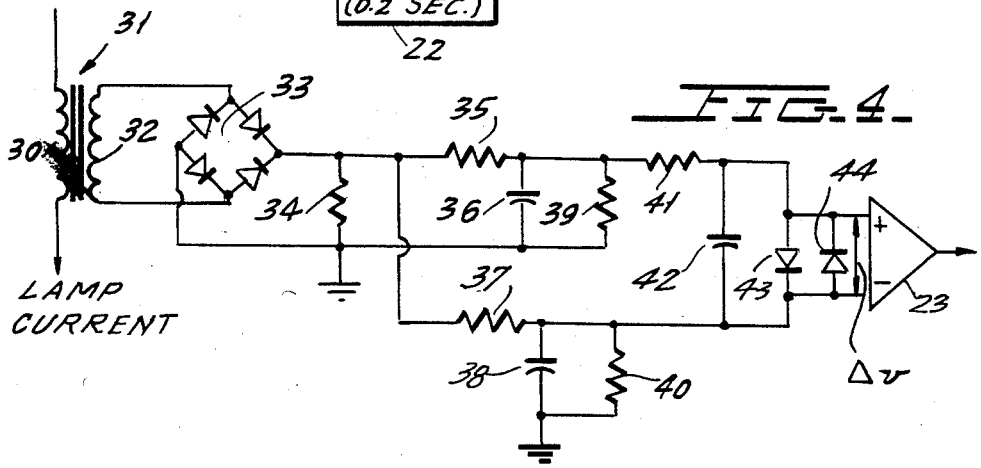
FIG. 4 is a detailed circuit diagram of the circuit of FIG. 3.

FIG. 4 is a circuit diagram which implements the block diagram of FIG. 3. Referring to FIG. 4, total lamp current from a.c. source 10 flows through the primary winding 30 of current transformer 31. The secondary winding 32 of the current transformer 31 is connected to the full wave bridge connected rectifier 33 which has a burden resistor 34 connected across its d.c. terminal. The voltage across the burden resistor 34 is directly proportional to the load lamp current flowing through winding 30.

An R-C circuit consisting of resistor 35 and capacitor 36 defines the long time delay circuit 21. The resistor 35 can be a 220K resistor and capacitor 36 can be a 22 microfarad capacitor.

The short time delay circuit 22 consists of the resistor 37 and capacitor 38 where resistor 37 can be a 15K resistor, while capacitor 38 is a 22 microfarad capacitor.

The outputs of the long time delay and short time delay circuits are then connected across resistors 39 and 40, respectively, and are applied through a third filter consisting of resistor 41 and capacitor 42, and anti-parallel connected diodes 43 and 44 which are connected across the positive and negative input terminals of comparator 23. The output of the comparator 23, as is shown in FIG. 3, is then connected to the lamp striking sequence circuit 24.

It should be noted that the lamp striking sequence circuit 24 can be implemented in any manner desired and could, for example, consist of a resistor and capacitor disposed in a fade circuit which is used to control the rate of change of dimming of the lamps as disclosed in U.S. Pat. No. 4,350,935.

Although the present invention has been described in connection with a preferred embodiment, many variations and modifications will become apparent to those skilled in the art. It is preferred, therefore, that the present invention be limited not by the specific disclosure herein, but only by the appended claims.

What is claimed is:

1. A gas discharge lamp lighting system comprising:

a main power source;

at least one gas discharge lamp and ballast combination;

a control circuit connected between said main power source and said lamp and ballast combination and regulating the power applied to said lamp and ballast combination from said main power source;

switch means connecting said control circuit and said lamp and ballast combination;

first circuit means connected to said switch means for detecting when said switch means is activated to cause power from said control circuit to be applied to said lamp and ballast combination, said first circuit means comprising load current measuring means for measuring and producing an output indicative of the load current through said lamp and ballast combination, a long time delay circuit responsive to said output of said measuring means for producing a sampling signal output having a waveform which is proportional to but delayed with respect to said output of said measuring means, a short time delay circuit responsive to said output of said measuring means for producing an output having a waveform which is delayed with respect to and proportional to said output of said measuring means and which suppresses line-transient variations associated with said output of said measuring means, a comparator circuit having first and second inputs connected to said outputs of said long time delay circuit and said short time delay circuit, respectively, and having an output which switches whenever said short time delay circuit output reaches a given value relative to said long time delay output;

second circuit means connected to said first circuit means and activated by the switching of said output of said comparator for activating said control circuit to, increase its output from an initial value to a full rated output in a smooth and continuous manner in a first predetermined time period, remain at full rated output for a second predetermined time period which begins immediately upon completion of said first predetermined time period, and reduce its output from full rated output to said initial value in a smooth and continuous manner in a third predetermined time period which begins immediately upon completion of said second predetermined time period.

2. The system of claim 1 wherein said first circuit means includes a current transformer and a bridge rectifier connected to the output of said control circuit for measuring said load current.

3. The process of connecting a first plurality of gas discharge lamps in parallel with a second plurality of gas discharge lamps which are energized from a power source and wherein a first voltage is applied to said second plurality of lamps which is lower than its nominal full value to dim the illumination output of said second plurality of lamps to below their full available illumination; said process comprising the steps of connecting said first plurality of lamps in parallel with said second plurality of lamps; measuring the load current through said first and second plurality of gas discharge lamps and producing an output representative of said load current; producing a long time delayed version of said output representative of said load current and a short time delayed version of said output representative of said load current, said long time delayed output providing a sampling period during which the level of said load current is determined, said short time delayed output having a response characteristic which suppresses line transient variations associated with said load current; comparing said long time delayed and short time delayed outputs and producing a comparator output which switches whenever said short time delayed output reaches a given value relative to said long time delayed output; increasing, in response to said switching, the voltage applied to said first and second pluralities of lamps to a second voltage which is greater than said first voltage and which is high enough to ensure striking of said first plurality of lamps and over a period long enough to avoid causing an instantaneous change in the illumination level of said second bank of lamps; and thereafter maintaining said second voltage for a second period which is at least sufficiently long to permit said first plurality of lamps to reach a stable ignition condition, and thereafter reducing the voltage across said first and second pluralities of lamps to said first voltage in a third period which is at least sufficiently long that the reduction in illumination level will be unnoticeable to casual observers.

4. The process of claim 3 in which said first period is from 1 to 3 seconds.

5. The process of claim 3 in which said second and third periods are greater than about 30 seconds.

6. The process of claim 4 in which said second and third periods are greater than about 30 seconds.

7. The process of claim 6 wherein said second voltage is said full nominal voltage.

8. The process of claim 3 wherein said first and second pluralities of lamps are fluorescent lamps.

9. The process of claim 7 wherein said first and second pluralities of lamps are fluorescent lamps.

10. A control circuit for initiating a load switching control operation in response to the connection of a first plurality of gas discharge lamps in parallel with a second plurality of lamps and wherein said second plurality of lamps are excited in a less than full illumination condition; said control circuit comprising load current measuring means for measuring the load current to said first and second pluralities of lamps and for producing an output representative thereof; a long time delay circuit responsive to said output of said measuring means for producing a sampling signal output having a waveform which is proportional to but delayed with respect to said output of said measuring means, a short time delay circuit responsive to said output of said measuring means for producing an output having a waveform which is delayed with respect to and proportional to said output of said measuring means and which suppresses line-transient variations associated with said output of said measuring means; a comparator circuit having first and second inputs connected to said outputs of said long time delay circuit and said short time delay circuit respectively and having an output which switches whenever said short time delay circuit output reaches a given value relative to said long time delay output; and voltage switching means responsive to the switching of said output of said comparator circuit for increasing the voltage applied to said lamps to a full rated value in a smooth and continuous manner over a first time period, maintaining said voltage at said full rated value for a second time period which is sufficient for striking said first plurality of gas discharge lamps, and reducing said voltage to a lower value which corresponds to said less than full elimination condition over a third time period.

11. The control circuit of claim 10 wherein said long time delay circuit and said short time delay circuit are resistance-capacitance circuits.

12. The control circuit of claim 10 wherein said long time delay circuit has a time delay of about 1.5 seconds and said short time delay circuit has a time delay of about 0.2 second.

13. The control circuit of claim 11 wherein said long time delay circuit has a time delay of about 1.5 seconds and said short time delay circuit has a time delay of about 0.2 second.

14. The control circuit of claim 10, wherein said first time period is from 1 to 3 seconds.

* * * * *